United States Patent [19]

Zwep

[11] 4,205,251

[45] May 27, 1980

[54] X-RAY TUBE FOR THE EXAMINATION OF FINE STRUCTURES

[75] Inventor: Gerrit Zwep, Eindhoven, Netherlands

[73] Assignee: U.S. Philips Corporation, New York, N.Y.

[21] Appl. No.: 834,958

[22] Filed: Sep. 20, 1977

[30] Foreign Application Priority Data

Oct. 4, 1976 [NL] Netherlands ..... 7610948

[51] Int. Cl.[2] ..... H01J 35/08

[52] U.S. Cl. ..... 313/330; 313/55; 313/311

[58] Field of Search ..... 313/311, 330, 55

[56] References Cited

U.S. PATENT DOCUMENTS

| | | | |
|---|---|---|---|
| 2,090,636 | 8/1937 | Olshevsky | 313/330 X |
| 2,250,322 | 7/1941 | Atlee | 313/330 X |
| 3,914,633 | 10/1975 | Diemer et al. | 313/55 |
| 3,934,164 | 1/1976 | Braun et al. | 313/330 |
| 4,000,433 | 12/1976 | Rohmfeld | 313/330 |

*Primary Examiner*—Saxfield Chatmon, Jr.
*Attorney, Agent, or Firm*—Algy Tamoshunas

[57] ABSTRACT

An additive which protects the anode against roughening is included in a surface layer of the anode of an X-ray source for generating X-rays within a comparatively narrow wavelength range. The additive is provided by deposition of material in vacuum, followed by diffusion of the material into the anode body.

4 Claims, 1 Drawing Figure

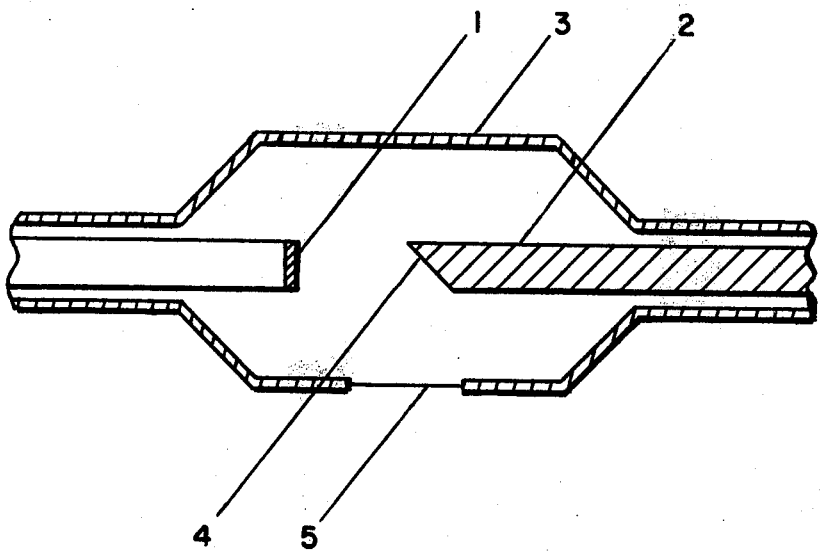
1
3
2
4
5

X-RAY TUBE FOR THE EXAMINATION OF FINE STRUCTURES

The invention relates to an X-ray tube which is notably suitable for the examination of fine structures and which comprises an electron source for generating an electron beam and an anode which is composed of a metal having a suitable heat conductivity and a metallic additive.

An X-ray tube of this kind is known, for example, from German Patent application No. 2357687. The anode of an X-ray tube described therein consists of an alloy of copper and a small quantity of silver. A copper-silver alloy is the basic material used in the fabrication of the anode body of such X-ray tubes.

The object of the invention is to provide an X-ray tube for generating comparatively good monochromatic radiation, without the need for using an alloy in forming the anode body. To this end, in accordance with the invention an X-ray tube of the kind described is characterized in that the additive is provided by diffusion in the portion of the anode surface which is to be struck by the electron beam.

The invention is based on the recognition of the fact that the additive need merely be present in a thin surface layer of the material to be struck by the electron beam. The electron beam will then also generate an X-ray beam having a comparatively narrow wavelength range which is not widened by the added metal. Because the additive may, with this arrangement, be provided, if desired, after the fabrication of the anode has been completed, a substantially higher degree of freedom exists in the manufacture of the anode disks. The drawback of more difficult processability, notably poor solderability, mentioned in the cited patent application does not occur with the anode of the invention.

The anode body in a preferred embodiment of the invention is made of copper with a surface layer to which a small quantity of material such as cobalt, chromium, iron or silver, which prolongs the service life of the anode, has been added by diffusion.

The invention will now be described with reference to the accompanying drawing diagrammatically illustrating an X-ray tube according to the invention.

As shown in the drawing, the preferred embodiment for the examination of fine structures comprises a cathode 1 and an anode 2 which are arranged in an envelope 3 having, for example, a beryllium window 5. A surface layer 4 of the anode body is provided with a metallic additive. This layer has a thickness of, for example, some tens of micrometers and contains, for example, from 0.005 to 0.5% by weight of additive. The additive may consist, for example, of cobalt, chromium, iron, silver or mixtures of these metals. The additive can be provided, for example, by arranging, one or more anode bodies in a vapour-deposition bell. A small quantity of the desired metal or mixture of metals is then unilaterally provided by vapour-deposition or sputtering and by subsequently diffusing this layer into the anode body by heating the anode body or bodies. If desired, the surface may be machined, for example, polished either in advance or later. Alternatively, a plate of the anode material can be provided with a surface layer in the above manner. The anode bodies are then formed from this plate. The quantity of additive to be added and the thickness of the mixture layer can be controlled by choosing an appropriate quantity of metal to be vapour-deposited, as well as by the temperature and the duration of diffusion. Any desired mixing ratio can be obtained by the simultaneous or alternating deposition of different materials.

The desired mixing ratio of basic material and additive can be obtained, for example, by polishing the diffused disks since this ratio decreases as the depth, i.e. the distance from the surface, increases.

In a further preferred embodiment, the additive is provided by direct diffusion, i.e. by material contact, at least at the area of the ultimate focus path, between the basic anode material and a block of the metal to be added, and by heating, at a comparatively high pressure, to the appropriate diffusion temperature for a period of time which is determined by the desired mixing ratio.

What is claimed is:

1. An X-ray tube comprising an envelope, an anode and a cathode for generating an electron beam, said anode and said cathode being arranged in said envelope in spaced relationship such that said electron beam strikes a surface portion of said anode to thereby generate X-ray radiation of a predetermined wavelength range, and an additive selected from the group consisting of cobalt, chromium, iron, silver, and mixtures thereof diffused into said surface portion for increasing the heat resistance of said anode without significantly affecting the wavelength range of said X-ray radiation.

2. The X-ray tube according to claim 1 wherein said anode is made of copper.

3. The X-ray tube according to claim 1 wherein the layer of said surface portion having said additive contains from 0.005% to 0.5% by weight of said additive.

4. The X-ray tube according to claim 3 wherein said surface layer with said additive has a thickness of no more than a few tens of micrometers.

* * * * *